US006973286B2

(12) United States Patent
Mandel et al.

(10) Patent No.: US 6,973,286 B2
(45) Date of Patent: Dec. 6, 2005

(54) HIGH PRINT RATE MERGING AND FINISHING SYSTEM FOR PARALLEL PRINTING

(75) Inventors: Barry P. Mandel, Fairport, NY (US); Robert M. Lofthus, Webster, NY (US); Steven R. Moore, Rochester, NY (US); Martin Krucinski, Webster, NY (US); Lisbeth S. Quesnel, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/761,522

(22) Filed: Jan. 21, 2004

(65) Prior Publication Data

US 2005/0158094 A1 Jul. 21, 2005

(51) Int. Cl.[7] ..... G03C 15/00

(52) U.S. Cl. ..... 399/391; 399/383; 399/388; 399/407; 400/605

(58) Field of Search ..... 399/383, 407, 399/110, 391, 410, 388; 400/605

(56) References Cited

U.S. PATENT DOCUMENTS

| | | | | |
|---|---|---|---|---|
| 4,579,446 | A | 4/1986 | Fujina et al. | |
| 4,587,532 | A | 5/1986 | Asano | |
| 4,727,402 | A * | 2/1988 | Smith | 399/368 |
| 5,098,074 | A * | 3/1992 | Mandel et al. | 270/58.13 |
| 5,208,640 | A | 5/1993 | Horie et al. | |
| 5,272,511 | A | 12/1993 | Conrad et al. | |
| 5,326,093 | A | 7/1994 | Sollitt | |
| 5,547,225 | A * | 8/1996 | DeAngelis | 281/21.1 |
| 5,568,246 | A | 10/1996 | Keller et al. | |
| 5,570,172 | A | 10/1996 | Acquaviva | |
| 5,596,416 | A | 1/1997 | Barry et al. | |
| 5,722,031 | A * | 2/1998 | Fujii et al. | 399/410 |
| 5,995,721 | A | 11/1999 | Rourke et al. | |
| 6,474,806 | B2 * | 11/2002 | Terauchi et al. | 347/104 |
| 6,608,988 | B2 | 8/2003 | Conrow | |
| 6,682,237 | B2 * | 1/2004 | Cocklin et al. | 400/624 |
| 6,785,013 | B1 * | 8/2004 | Ota et al. | 358/1.15 |
| 2003/0077095 | A1 | 4/2003 | Conrow | |

FOREIGN PATENT DOCUMENTS

JP 11348385 A * 12/1999 ..... B41J 29/38

OTHER PUBLICATIONS

"Xerox Disclosure Journal", Nov.-Dec. 1991, vol. 16, No. 6, pp 381-383. "Integration of Black Only and Color Printers".
Xerox Aug. 3, 2001 "TAXI" publication "Cluster Printing Solution Announced".
U.S. Appl. No. 60/478,749 entitled "Universal Flexible Plural Printer To Plural Finisher sheet Integration System".

* cited by examiner

*Primary Examiner*—Andrew H. Hirshfeld
*Assistant Examiner*—Dave A. Ghatt
(74) *Attorney, Agent, or Firm*—Eugene O. Palazzo; Fay, Sharpe, Fagan, Minnich & McKee, LLP

(57) ABSTRACT

A system for printing media includes a plurality of marking engines for outputting printed media in a stream, a media path system operable to transport the printed media from the marking engines to one or more finishing stations such that the streams are merged and transported one on top of the other and one or more finishing stations capable of compiling media in groups of 2 or more sheets for post processing the printed media into one or more completed jobs.

18 Claims, 6 Drawing Sheets

HIGH PRINT RATE MERGING AND FINISHING SYSTEM FOR PARALLEL PRINTING

BACKGROUND

1. Field

The disclosed embodiments relate to image production and, more particularly, to a system and method for printing and finishing media.

2. Brief Description of Related Developments

Incorporated by reference, where appropriate, by way of background, are the following references variously relating to what have been variously called "tandem engine" printers, "cluster printing", "output merger" etc., for example, Xerox Corp. U.S. Pat. No. 5,568,246 issued Oct. 22, 1996; Canon Corp. U.S. Pat. No. 4,587,532; Xerox Corp. U.S. Pat. No. 5,570,172 to Acquaviva; T/R Systems Barry et al U.S. Pat. No. 5,596,416; Xerox Corp. U.S. Pat. No. 5,995,721 to Rourke et al; Canon Corp. Fujimoto U.S. Pat. No. 4,579,446; Xerox Corp. Provisional Application No. 60/478,749 filed Jun. 16, 2003 by Robert J. Lofthus, et al, entitled "UNIVERSAL FLEXIBLE PLURAL PRINTER TO PLURAL FINISHER SHEET INTEGRATION SYSTEM; a 1991 "Xerox Disclosure Journal" publication of November–December 1991, Vol. 16, No. 6, pp. 381–383; and the Xerox Aug. 3, 2001"TAX" publication product announcement entitled "Cluster Printing Solution Announced". By way of an example of a variable input and output level output connector for a "universal" single printer to finisher interface there is noted a Xerox Corp. U.S. Pat. No. 5,326,093.

The latter is noted and incorporated as an additional possibly optional feature here, since various printers and third party finishers may have different respective sheet output levels and sheet input levels.

Cluster printing systems enable high print speeds or print rates by grouping a number of slower speed marking engines in parallel. These systems are very cost competitive and have an advantage over single engine systems because of their redundancy. For example, if one marking engine fails, the system can still function at reduced throughput by using the remaining marking engines. One disadvantage of existing cluster systems is that the output is not merged, meaning that an operator may have to gather the output of a distributed job from multiple exit trays. Another disadvantage is that redundant finishers may be required.

When creating a parallel printing system, feeding and finishing may be implemented in a number of different ways. For example, a single high speed feeder system could be used to deliver sheets to the parallel marking engines, or alternatively, each engine could have its own dedicated feeder or feeders. A similar situation exists on the output side. A dedicated finisher could be used for each marking engine, or the output could be combined into a single finisher. One disadvantage of presently available systems is that once configured, the feeding, marking, finishing systems, and the media paths between them are dedicated and not easily changeable.

Another problem arises from merging the output of multiple marking engines. Presently, the relatively lower speed output of each printing engine is merged into an accelerated, high velocity media path as shown in FIG. 1. The path is accelerated in order to maintain an inter-document gap between sheets and to merge all the outputs into a single stream without slowing the outputs from the individual marking engines. The act of accelerating sheets to a different velocity may require a significant media path length, especially for accommodating large size media. If the sheets are accelerated to a high speed and re-circulation through one of the marking engines is required, for example, for duplex or multiformat printing, the sheets must be slowed to the marking engine speed which may require a significant length of media path, more complex drives, nip releases, etc. There are practical limits to the speed of the high velocity media path. In addition, the speed of the high velocity media path may be further limited by the capacity of the finishing equipment. For example, a system having a single finisher with a capacity of 200 pages per minute would require limiting the speed of the high velocity media path to that same number of pages per minute, or else would require routing sheets to another finishing location.

A system that could take advantage of any combination of feeding, marking, and finishing systems, and any combination of media paths would be advantageous.

SUMMARY

The disclosed embodiments are directed to printing and post processing media. In one embodiment, a system for printing media is disclosed including a plurality of marking engines for outputting printed media in a stream, one or more finishing stations for post processing the printed media, and a first media path system operable to transport the printed media from two or more of the marking engines to one or more finishing stations such that the streams are merged and transported one on top of the other.

In another embodiment, a method of operating a printing system is disclosed including outputting printed media in multiple streams, transporting the printed media such that the streams are transported one on top of the other, and post processing the printed media.

BRIEF DESCRIPTION OF THE DRAWINGS

The foregoing aspects and other features of the present disclosed embodiments are explained in the following description, taken in connection with the accompanying drawings, wherein.

DETAILED DESCRIPTION OF THE PREFERRED EMBODIMENT(S)

Figure 1:
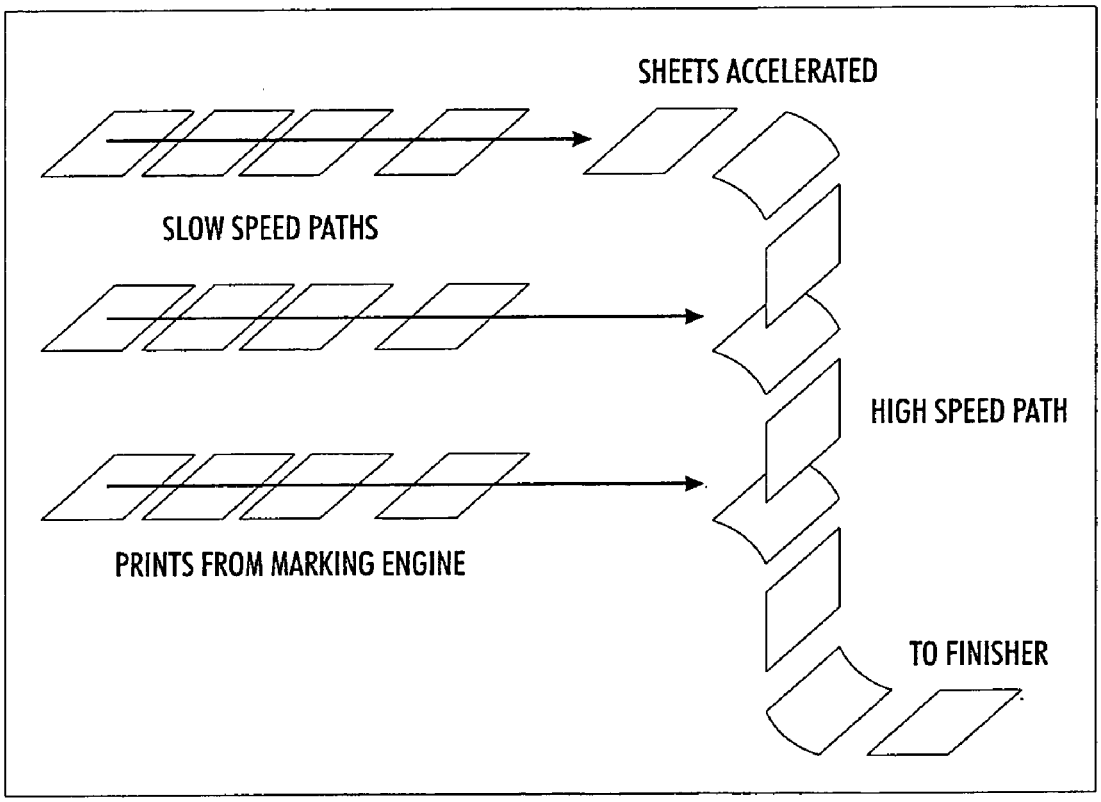
FIG. 1 is schematic diagram of a prior art high velocity media path.
Figure 2A:
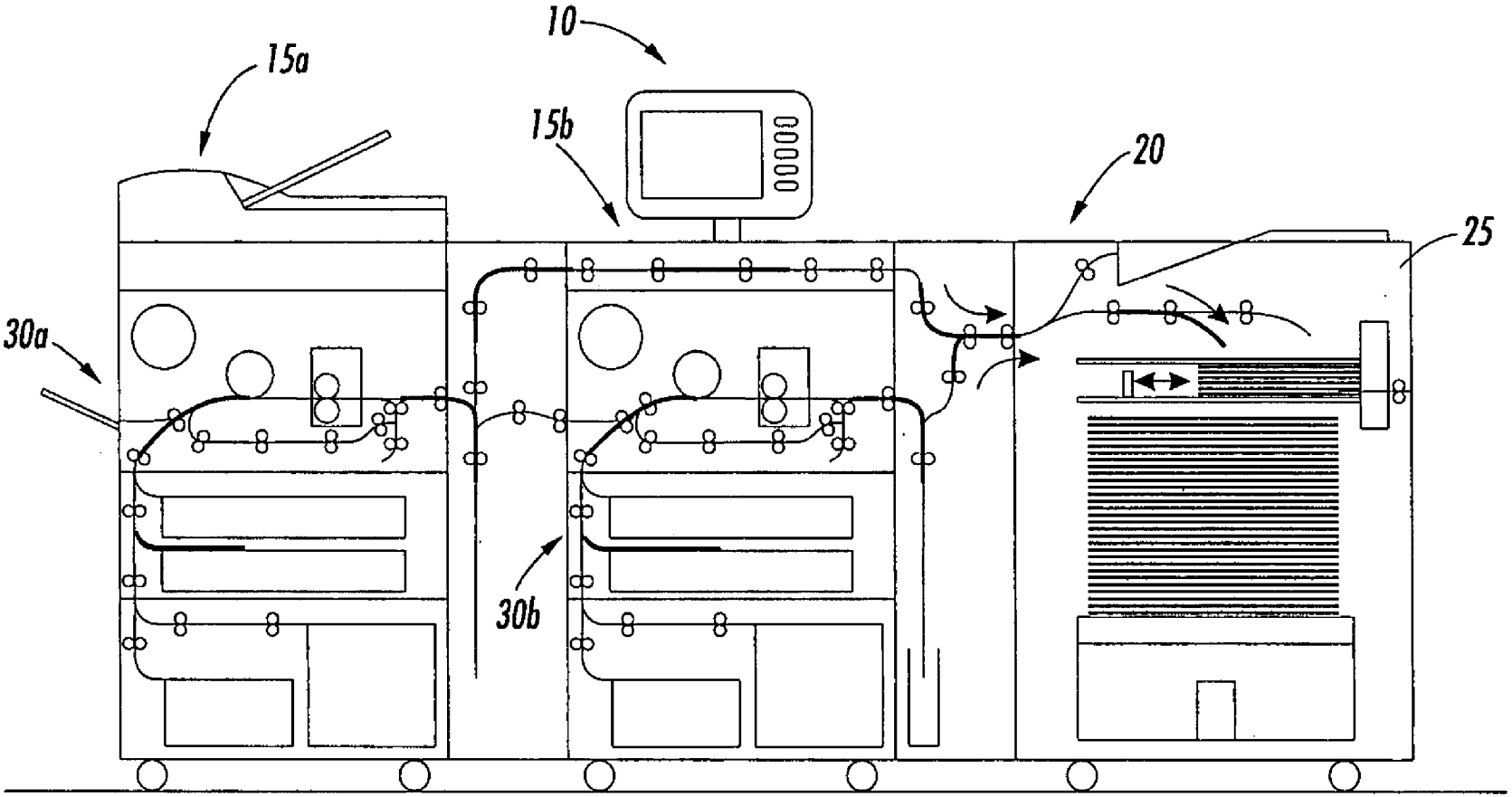
FIG. 2*a* is a schematic diagram of a printing system in accordance with the disclosed embodiments.
Figure 2B:
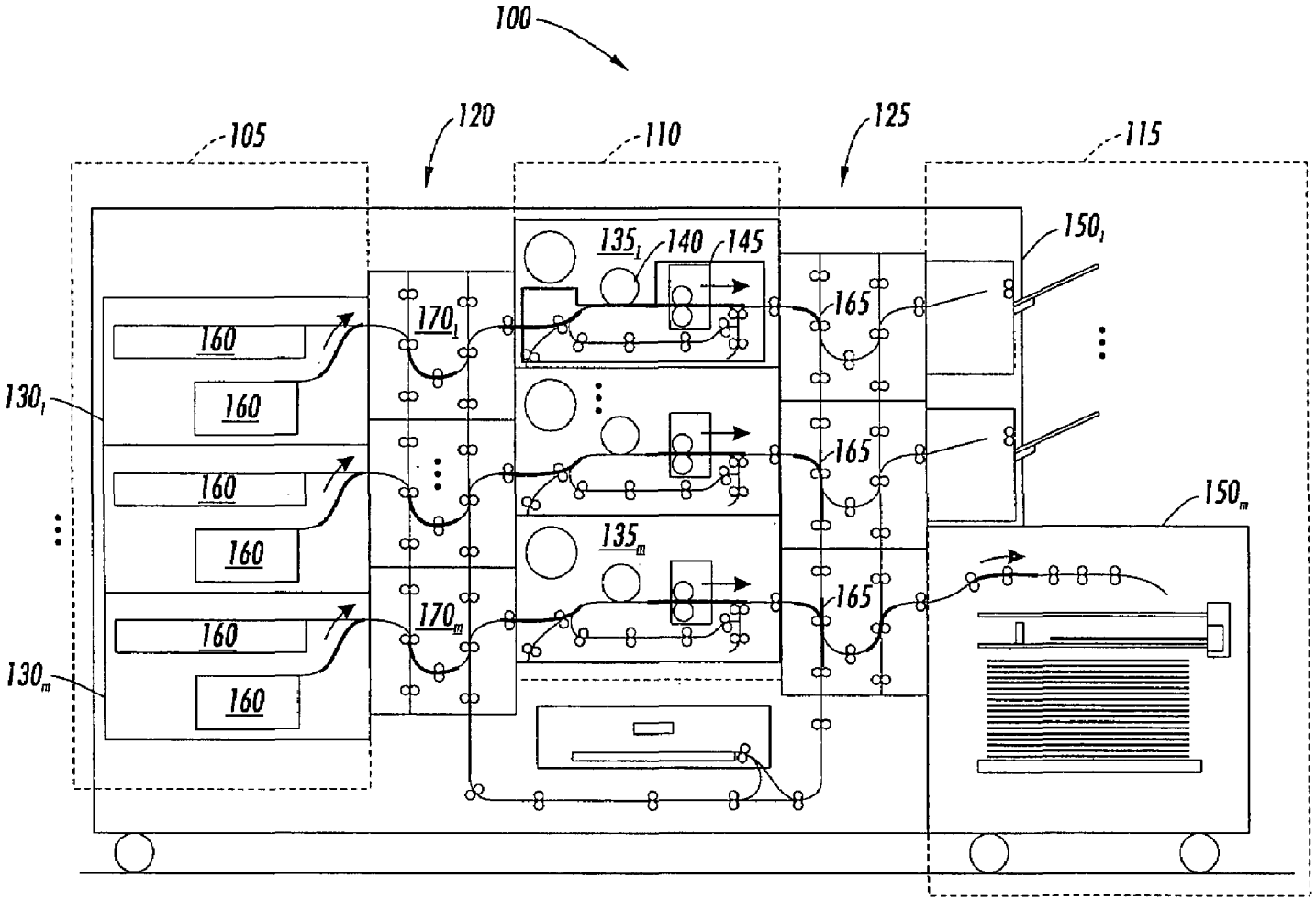
FIG. 2*b* is another schematic diagram of a printing system in accordance with the disclosed embodiments.

FIGS. 2*a* and 2*b* illustrate systems incorporating features of the disclosed embodiments. Although the disclosed embodiments will be described with reference to the embodiment shown in the drawings, it should be understood that the disclosed embodiments can be embodied in many alternate forms of embodiments. In addition, any suitable size, shape or type of elements or materials could be used.

As shown in FIG. 2*a*, a system 10 is generally a printing system that includes at least two marking systems 15*a*, 15*b* and a finishing system 20. A media path is provided such that the sheets printed by the two marking systems 15*a*, 15*b* can be merged, one on top of the other, at some point before delivery to the compiling station 25 of the finishing system 20. It should be appreciated that this merging function could take place in the media path upstream of the finisher, as shown in FIG. 2*a*, or in the media path of the finishing system. In the embodiment shown in FIG. 2*a*, the two marking engines 15*a*, 15*b* each have their own dedicated feeding systems 30*a*, 30*b*, but it should be appreciated that an alternate feeding system that enables sheets to be fed from one or more feeder units to either marking engine could also be used. The embodiment shown in FIG. 2*a* shows 2 marking engines, however 3 or more marking systems could be used with a media path that enables the sheets from all marking systems to be merged before compiling.

As shown in FIG. 2*b*, system 100 is generally a printing system that includes a feeder system 105, a marking system 110, and a finishing system 115. Feeder system 105 and marking system 110 are coupled together by a media path 120, and marking system 110 and finishing system 115 are coupled together by a similar media path 125. Feeder system 105, marking system 110, and finishing system 115 may each comprise one or more feeder modules, marking engines, and finishing modules, respectively.

It is a feature of some of the disclosed embodiments to provide a media path that enables any of one or more feeder modules within feeder system 105 to deliver media to any of one or more marking engines within marking system 110. It is another feature of some of the disclosed embodiments to provide a media path that enables printed media from any of the one or more marking engines to be delivered to any of one or more finishing modules within finishing system 115. It is yet another feature of the disclosed embodiments to merge or stack printed media streams from the marking system on top of each other and to optionally feed the merged printed media as a group or set to one or more of the finishing modules.

Some of the disclosed embodiments thus provide a high level of routing flexibility. The disclosed embodiments also enable finishing and compiling at higher print rates than could otherwise be accomplished with a finisher that only handled handles one sheet at a time. For example, a finisher that uses tamping technology to compile sheets aat maximum print rate of 150 ppm, may be able to compile sheets at approximately 300 or 450 ppm if sheets were delivered to it in groups of 2 or 3.

In another embodiment, systems 10, 100 may operate to decrease a print rate of marking systems 15*a*, 15*b*, 110, in the event that heavyweight media, tabs, or other specialty stock is being used and may optionally operate without merging the outputs of marking systems 15*a*, 15*b*, 110.

Referring to FIG. 2*b*, feeder system 105 generally operates to provide media 160 to marking system 110. As mentioned above, feeder system 105 may comprise one or more feeder modules $\mathbf{130}_1 \ldots \mathbf{130}_n$. The operation of feeder modules $\mathbf{130}_1, \ldots \mathbf{130}_n$ may be coordinated together or in groups, or they may be operated independently. Feeder modules $\mathbf{130}_1 \ldots \mathbf{130}_n$ may be capable of providing media 160 in various forms for use by marking system 110. For example, feeder modules $\mathbf{130}_1 \ldots \mathbf{130}_n$ may provide media 160 in the form of paper, polymer, plastic, woven material, or any other type of media substrate suitable for use by marking system 110. Feeder modules $\mathbf{130}_1 \ldots \mathbf{130}_n$ may provide media 160 in the form of individual sheets, continuous rolls, or any other form appropriate for marking system 110.

Marking system 110 is generally adapted to apply images to media 160. The operation of applying images to media 160, for example, graphics, text, photographs, etc., is generally referred to herein as printing. The one or more marking engines $\mathbf{135}_1 \ldots \mathbf{135}_n$ of marking system 110 may utilize xerographic marking technology, however, any other marking technology may also be utilized as part of the disclosed embodiments. The one or more marking engines $\mathbf{135}_1 \ldots \mathbf{135}_n$ may be controlled independently or they may be controlled in a coordinated manner, either in groups or all together. Each marking engine $\mathbf{135}_1 \ldots \mathbf{135}_n$ may generally include an image transfer function 140 for applying images to media 160 and a media transport function 145.

Finishing system 110 generally operates to compile and finish printed media 165. The one or more finishing modules $\mathbf{150}_1 \ldots \mathbf{150}_n$ of finishing system 110 may generally include various devices for treating or handling printed media 165, for example, cutting, stacking, stapling, folding, inserting into envelopes, weighing, and stamping. At least one of the finishing modules $\mathbf{150}_1 \ldots \mathbf{150}_n$ may utilize a tamping operation for aligning printed media 165 where the sides of the media are contacted by a perpendicular surface.

Finishing modules $\mathbf{150}_1 \ldots \mathbf{150}_n$ are shown in this embodiment as being arranged in parallel, however, they may be arranged sequentially, in any combination of sequential and parallel arrangements, or in any other suitable manner. The operation of finishing modules $\mathbf{150}_1 \ldots \mathbf{150}_n$ may be coordinated individually, in groups, or all together.

Media path 120 operates to deliver media 160 from feeder system 105 to marking system 110, and media path 125 operates to deliver printed media 165 from marking system 110 to finishing system 115. Media paths 120, 125 may comprise one or more media path elements $\mathbf{170}_1 \ldots \mathbf{170}_n$ which may provide multiple routing options.

Figure 3:
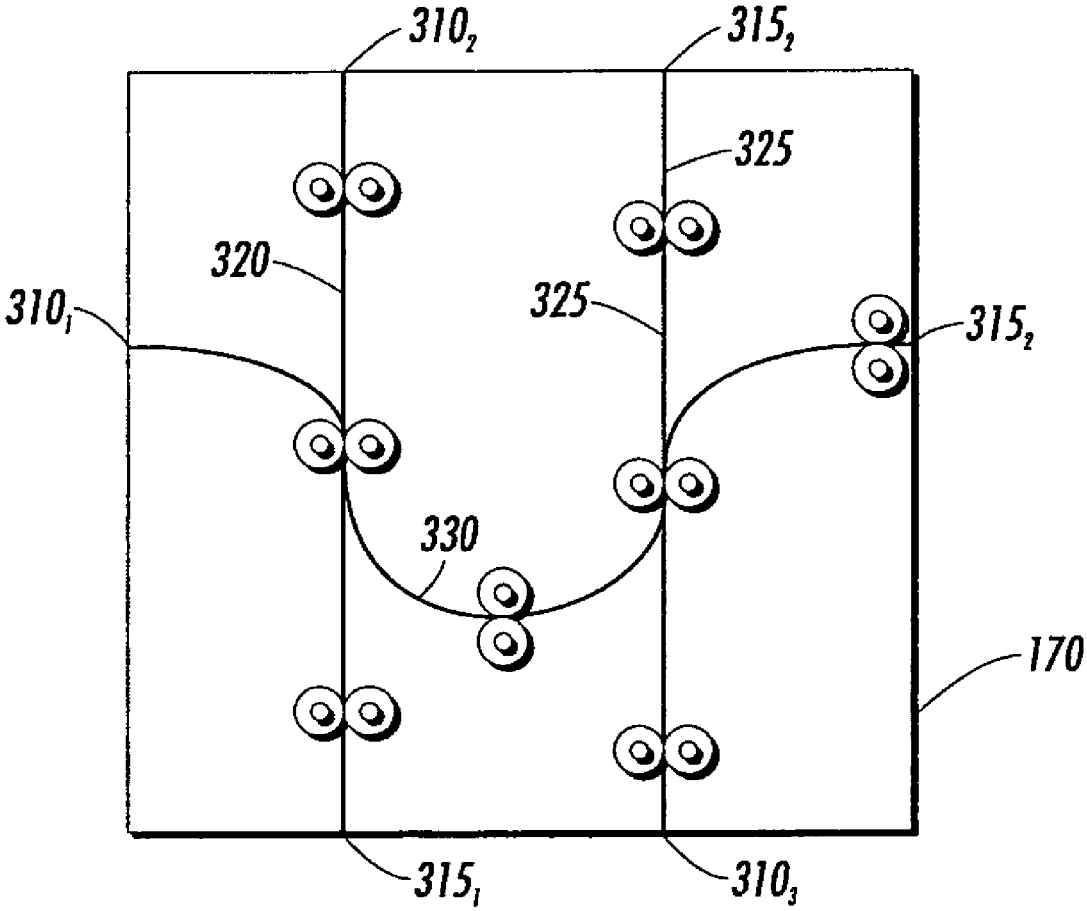
FIG. 3 shows an exemplary embodiment of a media path element in accordance with the disclosed embodiments.

FIG. 3 shows an exemplary embodiment of media path element 170. Media path element 170 generally includes two path sections 320, 325 that transport media in opposite directions along parallel paths. A third path section 330 enters media path element laterally at an intermediate location and "crosses" paths 320 and 325 and merges into and out of paths 320 and 325. A gate system (not shown) controls the media route through media path element 170. Path 320 includes input $\mathbf{310}_1$ and output $\mathbf{315}_1$. Path 325 includes input $\mathbf{310}_3$ and output $\mathbf{315}_2$. Path 330 includes input $\mathbf{310}_2$ and output $\mathbf{315}_3$.

While in this example, media path element 170 is shown as having 3 path sections, 3 inputs, and 3 outputs, it should be understood that media path element 170 may include any number of path sections, inputs, and outputs. Media 160 may accepted at inputs $\mathbf{310}_1, \ldots \mathbf{310}_3$ and selectively routed to any of outputs $\mathbf{315}_1 \ldots \mathbf{315}_3$. Media path element 170 may be modular, for example, any number of media path elements $\mathbf{170}_1 \ldots \mathbf{170}_n$ may be coupled together to provide one or more selectively routable media paths. This configuration provides a high degree of flexibility in media routing.

As shown in FIG. 2*b*, media path elements $\mathbf{170}_1 \ldots \mathbf{170}_n$, may provide a media path from any one of feeder modules $\mathbf{130}_1 \ldots \mathbf{130}_n$, to any one of marking engines $\mathbf{135}_1 \ldots \mathbf{135}_n$. Media path elements $\mathbf{170}_1 \ldots \mathbf{170}_n$ may be utilized in media path 125 to provide a media path from any one of marking engines $\mathbf{135}_1 \ldots \mathbf{135}_n$ to any one of finishing modules $\mathbf{150}_1 \ldots \mathbf{150}_n$. For example, one high speed feeder module could service multiple marking engines, or several feeder modules could supply multiple marking engines independently. Media path 120 is advantageous in that it does not rely on a single merged media path to supply marking engines $\mathbf{135}_1 \ldots \mathbf{135}_n$. If one or more feeder modules $130_1 \ldots 130_n$, media path elements $170_1 \ldots 170_n$, marking engines $135_1 \ldots 135_n$, or finishing modules $150_1 \ldots 150_n$ fails, media path 120 may still provide media pathways among functioning feeder modules, media path elements, marking engines, and finishing modules. This is particularly advantageous in parallel printing systems.

The modularity of media path element 170 may greatly simplify the design and development of printing system 100. This modularity also enables scalability of printing system 100, where feeder modules $130_1 \ldots 130_n$, marking engines $135_1 \ldots 135_n$, and finishing modules $150_1 \ldots 150_n$ may be added or removed as desired.

Figure 4:
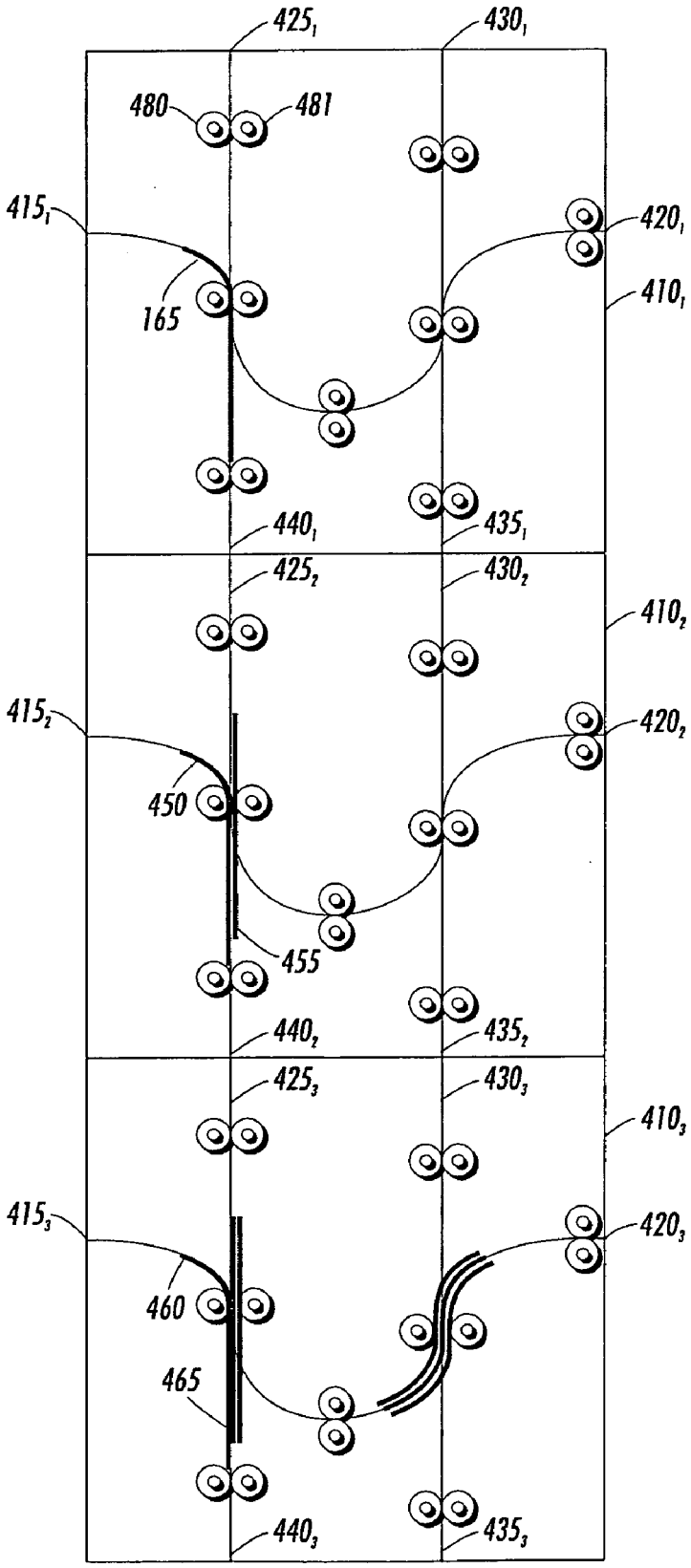
FIG. 4 shows another exemplary embodiment of a media path element in accordance with the disclosed embodiments.

FIG. 4 shows another exemplary embodiment of a media path element 410. Media path element 410 may be similar to media path element 170 in that it may be modular, and may be capable of selectively routing media from any of a number of inputs to any of a number of outputs.

According to the disclosed embodiments, media path element 410 may also be operable to accept media from one or more inputs and stack the media such that more than one substrate may travel in parallel along the same path and to convey the stack to a particular output.

While the embodiment in FIG. 4 is shown utilizing three media path elements $410_1, \ldots 410_3$, it should be understood that any number of media path elements 410 may be utilized. While each media path elements $410_1 \ldots 410_3$ is shown as having three inputs 415, 425, 435 and three outputs 420, 430, 440, it should be understood that media path elements $410_1, \ldots 410_3$ may have any number of inputs and outputs.

Referring to FIG. 4, media path elements $410_1 \ldots 410_3$ are coupled together such that output 440, of media path element $410_1$ is coupled to input $425_2$ of media path element $410_2$ and output $440_2$ of media path element $410_2$ is coupled to input $425_3$ of media path element $410_3$. Printed media 165 is introduced into input $415_1$, of media path element $410_1$, and is routed toward output $440_1$. In media path element $410_2$ additional printed media 450 is introduced into input $415_2$ and stacked or merged with printed media 165 from input $425_2$ to form a first stack 455. First stack 455 is routed toward output $440_2$. In media path element $410_3$ additional printed media 460 is introduced into input 4153 and stacked or merged with first stack 455 to form a second stack 465. Second stack 465 is then routed toward output 4303. Alternately, second stack 465 may be routed to any number of additional media path elements and merged with additional printed media.

Traditional media path drive nips include high friction, elastomer drive rollers on one side of the media path, and lower friction, idler rollers on the other side. Since more than one sheet are transported through the media path of the proposed system, and in particular through the path sections of media path element 410, the drive nips 480, 481 of media path element 410 could optionally include driven, high friction drive rollers on both sides of the media path. This will help prevent the additional sheets in the media path from slipping due to baffle friction, as they are transported through the system.

It should be understood that media paths 120, 125 may include any number of media path elements 170, 410, in any combination. It should also be understood that media path elements 170, 410 may be assembled in any sequential, parallel, or combination of sequential and parallel arrangement.

As can be seen, media path elements $410_1 \ldots 410_3$ operate to merge or stack multiple media streams on top of each other and to convey the stack to a particular output. The stacked media may be delivered to another operation, for example, a finishing module $150_1 \ldots 150_n$ (FIG. 2*b*).

Media path elements 170, 410 may also be configured to selectively stack media so that media may be stacked in variable sets. For example, the output of marking system 110 (FIG. 2*b*) may be stacked in groups of 3 sheets of printed media, and then later stacked in groups of 2 sheets of printed media. Any suitable stacking arrangement may be configured.

Media path elements 170, 410 may also be configured as buffers to temporarily hold images or media when a particular size group of sheets is not needed, and to deliver sheets to marking system 110 or finishing system 115 optionally smaller or larger groups as required.

This embodiment enables extremely high print rate compiling and finishing in parallel printing systems without requiring printed media 165 to be accelerated to a higher velocity, and without requiring a unique high speed finisher, finishing system or finishing module. Media may be printed in the proper sequence by one or more marking engines $135_1 \ldots 135_n$ (FIG. 2*b*) to achieve proper collation. Media path elements $410_1 \ldots 410_3$ may operate to merge printed media 165 with some degree of alignment, for example, media path elements $410_1 \ldots 410_3$ may align corresponding edges of printed media 165 in first and second stacks 455, 465 to within approximately 2 mm.

Figure 5:
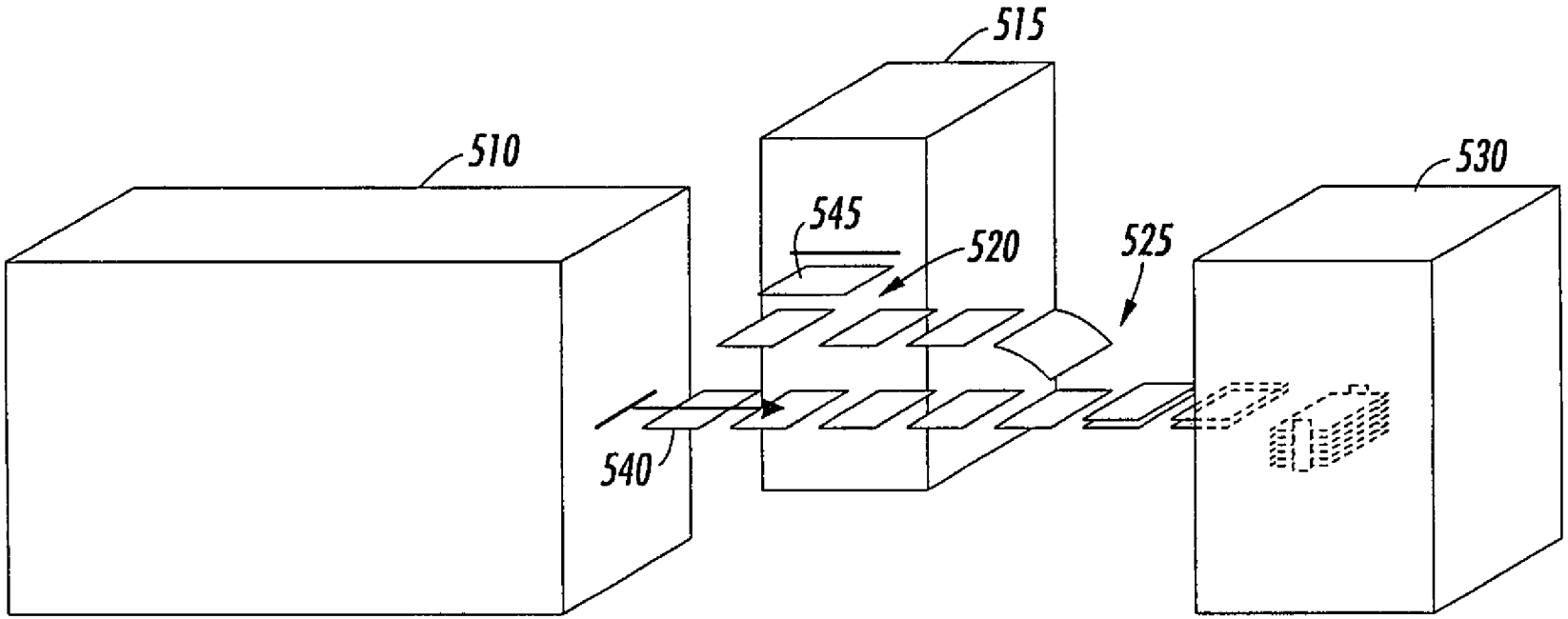
FIG. 5 shows another embodiment of a media path using a right angle or "radial" integration approach.

FIG. 5 shows another embodiment using a right angle or "radial" integration approach for marking engines 510, 515. In this embodiment, marking engines 510, 515 have output paths 540, 545, respectively, that are initially perpendicular to each other. A device 520 operates to align the direction of output paths 540, 545 so that they have the same direction and velocity. The media output from marking engines 510, 515, shown in this example as printed sheets may then be merged or stacked utilizing the structures and techniques described above, and then may be routed to subsequent operations, for example, finisher 525, or tamping finisher 530.

Thus, the disclosed embodiments provide a high level of flexibility in terms of media routing where various components of a printing system may be coupled to selectively supply other components. This provides operational flexibility and redundancy, allows for high speed parallel operations, and greatly reduces the size and complexity of the media path because high transport velocities are not required.

While particular embodiments have been described, various alternatives, modifications, variations, improvements, and substantial equivalents that are or may be presently unforeseen may arise to Applicant or others skilled in the in the art. Accordingly, the appended claims as filed and as they may be amended are intended to embrace all such alternatives, modifications, variations, improvements and substantial equivalents.

What is claimed is:

1. A printing system comprising;

a plurality of marking engines for outputting printed media in a stream;

one or more finishing stations for post processing the printed media; and a first media path system operable to transport the printed media from two or more of the marking engines to one or more finishing stations such that the streams are merged and transported one on top of the other and wherein the path system comprises first and second path sections that transport media in opposite directions along parallel paths, and a third path section that merges into and out of the first and second path sections such that media traveling along any of the first, second, or third path sections may be routed to any other of the first, second, or third path sections.

2. The printing system of claim 1, further comprising:

one or more media feeder systems; and a second media path system operable to transport media from any of the media feeder systems to any of the plurality of marking engines.

3. The printing system of claim 1, wherein the plurality of marking engines output printed media in parallel streams.

4. The system of claim 1, in which the one or more finishing stations are capable of compiling the media in groups of 2 or more sheets.

5. The system of claim 1, in which the one or more finishing stations comprise a tamping mechanism to post process the media.

6. The printing system of claim 1, wherein the first media path system further comprises transport drive nips having driven rollers on a top and bottom side of the media stream.

7. The printing system of claim 1, wherein the first media path system comprises at least one modular element.

8. The printing system of claim 7, wherein the at least one modular element is operable to selectively stack media in variable numbers of sheets.

9. The printing system of claim 7, wherein the at least one modular element is operable as a buffer to temporarily hold media.

10. The printing system of claim 7, wherein the at least one modular element is operable to route media from any of the plurality of marking engines to any of the one or more finishing stations in the event of a failure of a marking engine or finishing station.

11. A method of operating a printing system comprising;

outputting printed media in multiple streams;

transporting the printed media along first and second path sections that transport media in opposite directions along parallel paths and a third path section that merges into and out of the first and second path sections such that media traveling along any of the first, second, or third path sections may be routed to any other of the first, second, or third path sections; and post processing the printed media.

12. The method of claim 11, further comprising transporting media from any of a plurality of media feeder systems to any of a plurality of marking engines for outputting the multiple streams.

13. The method of claim 11, further comprising outputting the multiple streams in parallel.

14. The method of claim 11, wherein post processing the printed media includes tamping the printed media.

15. The method of claim 11, wherein transporting the printed media comprises driving a top and bottom side of the media stream.

16. The method of claim 11, wherein transporting the printed media comprises selectively stacking or compiling media in groups of variable numbers of sheets.

17. The method of claim 11, wherein transporting the printed media comprises temporarily buffering the media.

18. The method of claim 11, wherein the printing system includes a number of marking systems and finishing systems, and wherein transporting the printed media comprises routing media from any of the plurality of marking engines to any of the one or more finishing stations in the event of a failure of a marking engine or finishing station.

* * * * *